US010499743B2

(12) United States Patent
Frankel et al.

(10) Patent No.: US 10,499,743 B2
(45) Date of Patent: Dec. 10, 2019

(54) DISASSEMBLABLE FOLDING CHAIR

(71) Applicant: Zenithen USA LLC, Upland, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 0 days.

(21) Appl. No.: 15/729,700

(22) Filed: Oct. 11, 2017

(65) Prior Publication Data

US 2019/0104850 A1 Apr. 11, 2019

(51) Int. Cl.
*A47C 4/28* (2006.01)
*A47C 4/02* (2006.01)
*A47C 4/06* (2006.01)

(52) U.S. Cl.
CPC ..... *A47C 4/021* (2013.01); *A47C 4/02* (2013.01); *A47C 4/06* (2013.01); *A47C 4/286* (2013.01)

(58) Field of Classification Search
CPC .... A47C 4/30; A47C 5/10; A47C 4/18; A47D 1/02
See application file for complete search history.

(56) References Cited

U.S. PATENT DOCUMENTS 6,419,311 B1 * 7/2002 Tang ..... A47C 1/026 297/411.35
6,817,671 B1 * 11/2004 Zheng ..... A47C 4/286 297/188.14
7,073,852 B1 * 7/2006 Zheng ..... A47C 4/286 297/16.2
7,404,601 B2 * 7/2008 Chen ..... A47C 4/44 297/16.1
7,717,502 B2 * 5/2010 Deng ..... A47C 4/20 297/16.1
7,784,861 B1 * 8/2010 Deng ..... A47C 4/20 297/16.1
D706,050 S * 6/2014 Yang ..... D6/368
9,993,083 B2 * 6/2018 Choi ..... A47C 4/286
2003/0020304 A1 * 1/2003 Zheng ..... A47C 4/286 297/16.2
2009/0134673 A1 * 5/2009 Deng ..... A47C 4/20 297/16.2
2010/0237663 A1 * 9/2010 Deng ..... A47C 4/20 297/16.2
2010/0237664 A1 * 9/2010 Grace ..... A47C 4/286 297/16.2

(Continued)

*Primary Examiner* — Shin H Kim
(74) *Attorney, Agent, or Firm* — Merek, Blackmon & Voorhees, LLC

(57) ABSTRACT

The invention is to a type of disassemblable folding chair that includes supports legs on two sides and an upholstered seat back. The support legs include front-tilting support bars and rear-tilting support bars that are cross-hinged with movable hinge joints. Within this structure, the front-tilting support bars on the two sides and the rear-tilting support bars on the two sides are joined together by two cross-hinged diagonal bars. One end of the diagonal bars is directly hinged onto the two front-tilting and rear-tilting support bars; the other end is hinged on the front-tilting and rear-tilting support bars via a detachable structure. When disassembled, the two support legs can be folded together.

7 Claims, 4 Drawing Sheets

(56) References Cited

U.S. PATENT DOCUMENTS

| | | | | |
|---|---|---|---|---|
| 2014/0167473 | A1* | 6/2014 | Yang | A47C 1/14<br>297/354.1 |
| 2016/0051054 | A1* | 2/2016 | Choi | A47C 4/286<br>297/4 |

* cited by examiner

DISASSEMBLABLE FOLDING CHAIR

BACKGROUND OF THE INVENTION

Field of the Invention

The invention is to a folding chair that is disassemblable.

Technical Background

There are currently flat surface folding chairs that may be produced in a variety of designs. However, the design that assembles the chair with two cross-hinged support bars located on the left and right sides is the simplest. Similar to Chinese patent application number 201320749983X that discloses a type of folding chair including two identical or symmetrical support legs on both sides, a seat cushion, and an upholstered seat back. The support legs include front-tilting support bars and crossed rear-tilting support bars that are cross-hinged with movable hinge joints. The rear-tilting support bars extend upwardly to the seat cushion to form support for the seat back. The seat back has two sections which are fitted with backrest cushions. The chair seat is installed on the seat bar. The movable hinge joint on the front of the seat bar, which is hinged to the upper end of the front-tilting support bar, and the movable hinge joint on the rear, which is hinged to the middle of the rear-tilting support bar, together create the weight supporting structure. The front-tilting support bars and the rear-tilting support bars on both sides are the two sections of a U-shaped bar or are connected together via their corresponding bars.

A second existing design is a further simplified structure, like Chinese patent application number 201420465689.0, which discloses a folding sofa that comprises support legs on both sides and the sofa body. Each support leg comprises a pair of front-tilting and rear-tilting support bars that are crossed and joined together by a movable hinge. The rear-tilting support bar is taller than the front-tilting support bar, with the taller portion providing support for the seat back. The front-tilting support bar and the rear-tilting support bar on both sides are two sections of the U-shaped bar. The sofa body is made of soft upholstered material, with built-in seats, armrests, and seat backs. The exterior of the seat backs and armrests is fitted with seat cushions and armrest cushions. The backrests are affixed to the seat backs via the seat back cushions. Using the front- and rear-tilting support bars to provide direct support for the sofa body is the most succinct design structure.

The two structures above only allow two-dimensional folding. They do not allow folding further from the left or the right sides. This creates inconvenience for packing, storing or transporting. Additionally, using the rear-tilting support bar to support the seat back at the same time affects the overall height after folding. How to overcome the inadequacy of existing technology and to come up with a more reasonable design has become a goal of this invention.

SUMMARY OF THE INVENTION

A primary goal of this invention is to design a bar component that connects the front-tilting support bars and the rear-tilting support bars on the two sides, both of which are pairs of diagonal bars. One end of the diagonal bar pair is affixed to a support bar in the form of a detachable structure. When detached, the support bars on both sides will collapse onto each other, creating a folding chair that is disassemblable. A secondary goal is to create a detachable structure for the rear-tilting support bar so that it reduces the overall height after folding.

The technical proposals of the invention is achieved in the following way:

It is a type of folding chair that can be assembled and disassembled. It includes support legs on both sides and an upholstered seat back.

The support legs include the front-tilting support bars and rear-tilting support bars that are crossed and joined together by a movable hinge.

The front-tilting support bars on the two sides and the rear-tilting support bars on the two sides are joined together by connecting bars to form a single unit.

The rear-tilting support bar is taller than the front-tilting support bar. The taller portion provides support for the seat back.

This invention may have one or more of the following characteristics:

Connecting the front-tilting support bars on both sides are two front diagonal bars that are cross-hinged.

One end of the aforementioned pair of front diagonal bars is directly hinged on the two front-tilting support bars; the other end is hinged on the front-tilting support bars via a detachable structure.

Connecting the rear-tilting support bars on both sides are two cross-hinged rear diagonal bars.

One end of the aforementioned pair of rear diagonal bars is directly hinged onto the two rear-tilting support bars; the other end is mounted on the rear-tilting support bars via a detachable structure.

On the aforementioned end of the front diagonal bar pair and the rear diagonal bar pair, the position of the detachable structure is secured by a bolt. There should be a plastic component affixed to each of the detachable positions that correspond to the front-tilting support bars and the rear-tilting support bars. That plastic component has a bolt hole so that the aforementioned bolt can be screwed on.

The aforementioned movable hinge that joins the front-tilting support bar and the rear-tilting support bar together belongs to one of the following two structures: 1) the front-tilting support bar and the rear-tilting support bar are crossed and joined together by a rivet hinge; and 2) the rear-tilting support bar is mounted with a sliding cap on the top, and the front-tilting support bar passes through that sliding cap to create the movable hinge.

The aforementioned rear-tilting support bar has a sectional structure which includes a support section and a seat back section. The seat back section is inserted at the end of the support section to be integrally connected to each other. The aforementioned upholstered seat back cushion is attached to the upper portion of the seat back area and the upper portion of the front-tilting support bars.

The aforementioned upper portion of the seat back area is mounted with an immovable plastic component for the seat back, and the upper portion of the front-tilting support bars is mounted with an immovable plastic component for the seat. The upholstered seat back cushions are directly affixed to the aforementioned plastic components for the seat and the seat back.

The aforementioned immovable plastic component for the seat is mounted on a short bar. The insertion of a short bar in the upper portion of the front-tilting support bars creates a fixed positioning structure.

The diameters of the seat back section and the support section of the rear-tilting support bars are preferably identical. A core tube is inserted in the lower part of the seat back section. This core tube is also inserted into the upper part of the support section so that the two sections are joined together as one unit.

This invention replaces the bar that connects the two support legs on the left and right sides with a set of diagonal bars. In addition, by way of a detachable structure positioned on one end of the diagonal bars, that end can be disassembled, allowing the support legs on both sides to be brought together and folded. Supplemented by a sectional design of the rear-tilting support bars, the overall height after folding is further reduced, so that the product size is even more compact after folding, more space efficient, more portable, and more convenient to store.

BRIEF DESCRIPTION OF THE DRAWINGS

Similar reference characters denote corresponding features consistently throughout the attached drawings. Namely, in the drawings the following reference numbers refer to the following parts.

Figure 1:
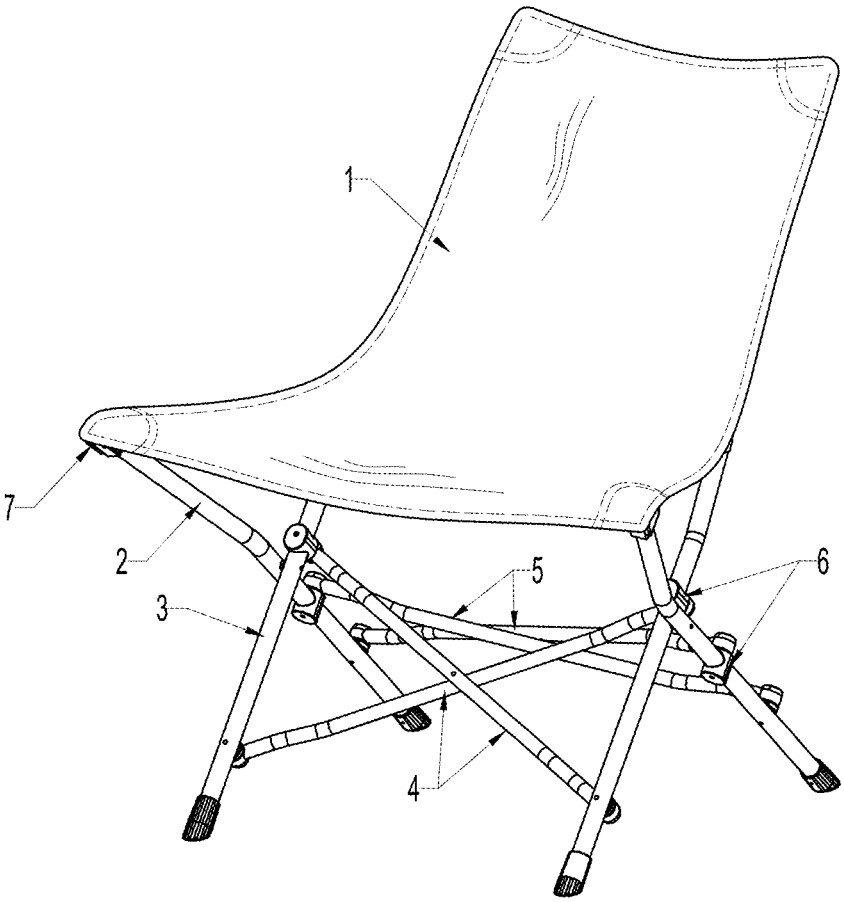
FIG. 1 is a 3D illustration of the disassemblable folding chair.

1—upholstered seat back
2—front-tilting support bar
3—rear-tilting support bar
31—support section
32—seat back section
321—core tube
4—front diagonal bar pair
5—rear diagonal bar pair
6—plastic component
7—plastic component for the seat
71—short bar
8—plastic component for the seat back
9—woven belt

DETAILED DESCRIPTION OF THE PREFERRED EMBODIMENT(S)

Figure 2:
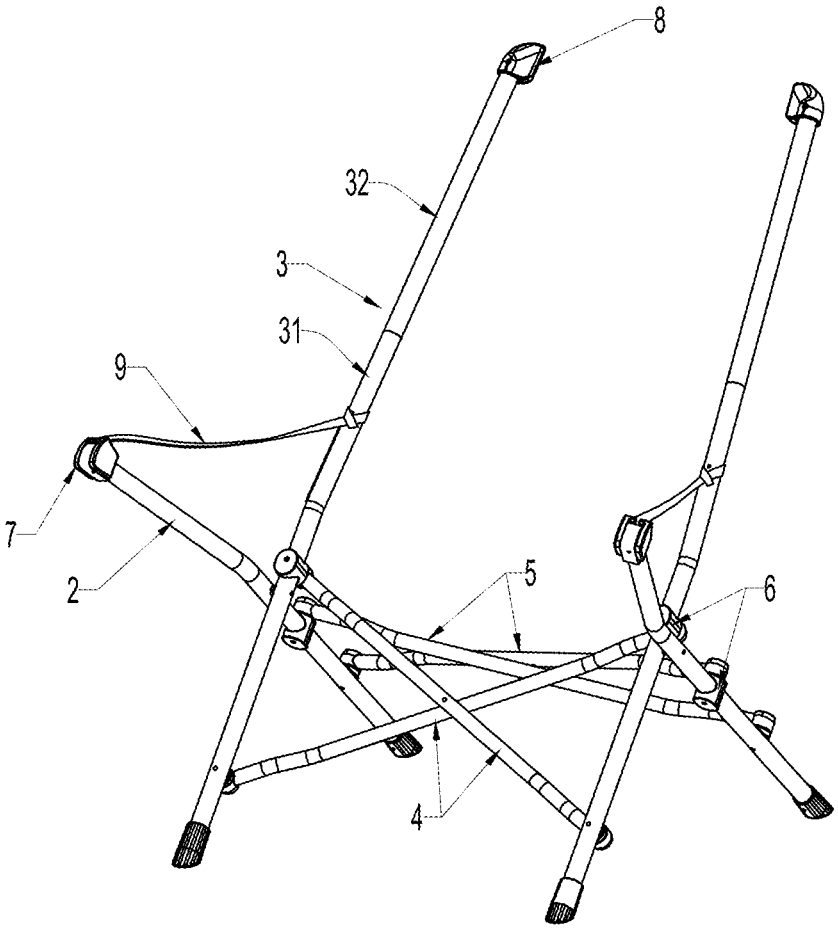
FIG. 2 is an illustration of the support legs of the disassemblable folding chair.
Figure 3:
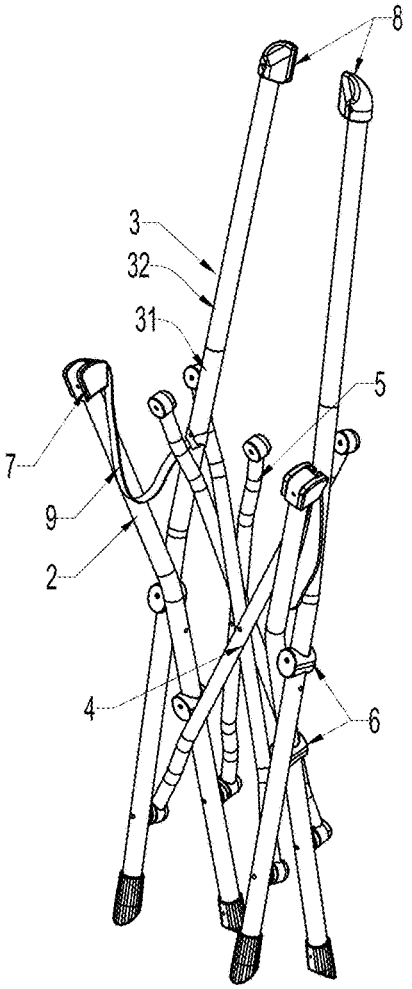
FIG. 3 is an illustration of the support legs of the disassemblable folding chair, folded.
Figure 4:
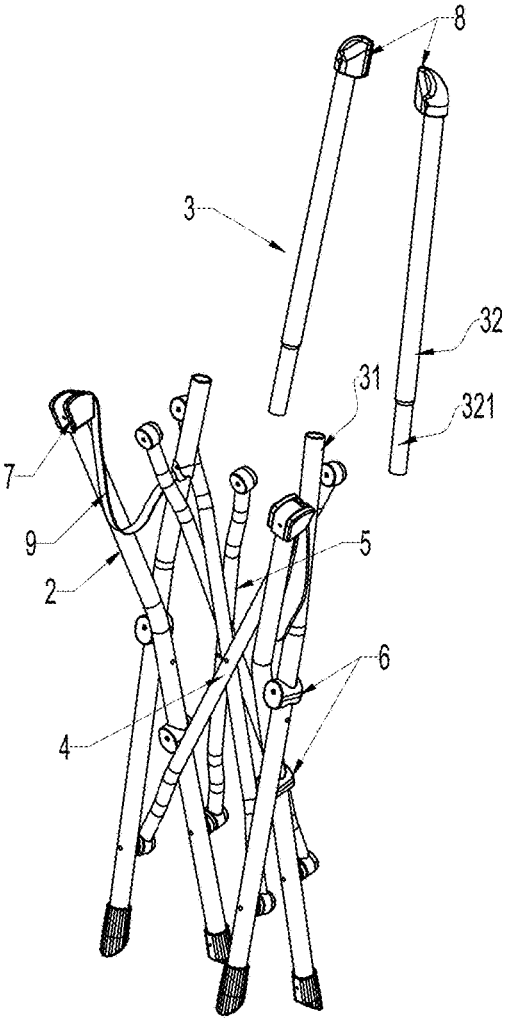
FIG. 4 is an illustration of the support legs and the seat back of the disassemblable folding chair, disassembled.

With reference to FIG. 1 to FIG. 4, the disassemblable folding chair includes an upholstered seat back 1 and two support legs on both sides. The support legs include front-tilting support bars 2 and rear-tilting support bars 3 that are crossed-hinged with movable hinge joints. The movable hinge that joins the front-tilting support bar 2 and the rear-tilting support bar 3 together belongs to one of the following two structures:

1) the front-tilting support bar 2 and the rear-tilting support bar 3 are crossed and joined together by a rivet hinge, as illustrated in FIG. 2. It is a direct crossed-hinge connection; or
2) the rear-tilting support bar 3 is mounted with a sliding cap on the top, and the front-tilting support bar 2 passes through that sliding cap to create the movable hinge. This design is characterized by its ability to support weight and its flexibility for the cross-hinged joint to move freely. It offers exceptional convenience during the unfolding and folding process, as well as providing a better seat design.

The front-tilting support bars 2 on the two sides and the rear-tilting support bars 3 on the two sides are joined together by diagonal bars to form a single unit.

Connecting the front-tilting support bars 2 on both sides are a pair of cross-hinged front diagonal bars 4. One end of the front diagonal bar pair 4 is directly hinged onto the two front-tilting support bars 2. The other end is hinged on the front-tilting support bars through a detachable structure.

Connecting the rear-tilting support bars 3 on both sides are a pair of cross-hinged rear diagonal bars 5. One end of the rear diagonal bar pair 5 is directly hinged onto the two rear-tilting support bars 3; the other end is hinged on the rear-tilting support bars via a detachable structure.

On the end of the front diagonal bar pair 4 and the rear diagonal bar pair 5, the position of the detachable structure is secured by a bolt. There should be a plastic component 6 affixed to each of the detachable positions that corresponds to the front-tilting support bars 2 and the rear-tilting support bars 3. That plastic component 6 has a bolt hole so that the aforementioned bolt can be screwed on. Once the bolt is unscrewed, one end of the front and rear diagonal bars 4, 5 will be detached from the restraint of the plastic component 6. The diagonal bars will follow the support legs on both sides to be folded together at the same time.

The rear-tilting support bars 3 are taller than the front-tilting support bars 2, with the taller portion providing support for the seat back. As such, the rear-tilting support bars adopt a sectional structure that includes a support section 31 and a seat back section 32. The seat back section 32 is inserted at the end of the support section 31 to be integrally connected to each other. Furthermore, the diameters of the seat back section 32 and the support section 31 of the rear-tilting support bars 3 are preferably identical. A core tube 321 is inserted in the lower part of the seat back section 32. This core tube 321 is also inserted into the upper part of the support section 31 so that the two sections are joined together as one unit.

The upholstered seat back cushions 1 are attached to the upper portion of the seat back area 32 and the upper portion of the front-tilting support bars 2. This creates an integrated design so that the seat back may be positioned upright or reclined.

In order for the upholstered seat back to receive better support, a plastic component for the seat 7 is installed on the upper part of the front-tilting support bars 2, and an immovable plastic component for the seat back 8 is mounted on the upper portion of the seat back 32. The upholstered seat back cushion 1 is directly affixed to the aforementioned plastic components for the seat 7 and the seat back 8.

Figure 5:
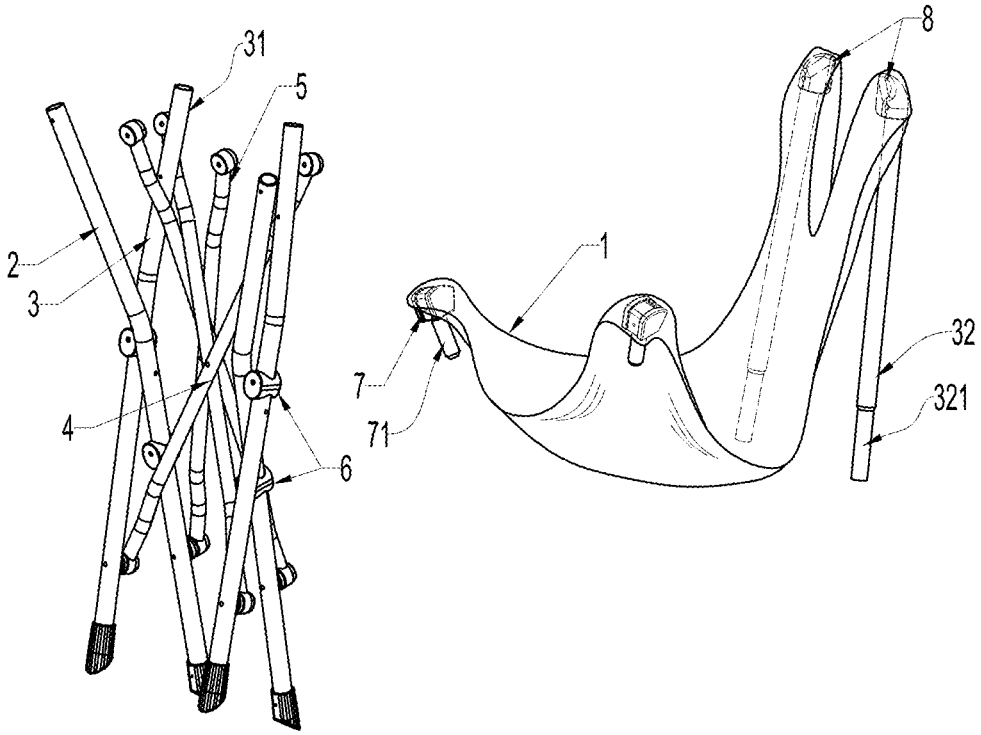
FIG. 5 is an illustration of the disassemblable folding chair with upholstered seat back, disassembled.

With reference to FIGS. 1, 2 and 5, the immovable plastic component for the seat 7 is mounted on a short bar 71. The insertion of a short bar 71 in the upper portion of the front-tilting support bars 2 creates a fixed positioning structure. It allows the upholstered seat 1 to be disassembled at the same time, offering convenience for folding and storage. In this structure, a symmetrical design for the front-tilting support bars 2 and the rear-tilting supports bars 3 may be used. The symmetrical design is a more flexible design option. It allows the short bar 71 and the seat back section 32 to be freely inserted in the front-tilting support bars 2 or the seat back section 32 of the rear-tilting support bars.

As illustrated in FIG. 2, other than using the chair seat to restrain the opening angle, a woven belt 9 may be used between the font-tilting support bars 2 and the rear-tilting support bars 3. One end of the woven belt may be securely tied to the upper part of the front-tilting support bars 2, while the other end is securely tied to the rear-tilting support bars 3 at a position that corresponds to their height. This creates a form of restraint and offers support for opposite-facing upholstered seat back 1 and the two sides of the chair seat.

Alternatively, a plastic component may be used at the crossed-hinge joint of the front-tilting support bars 2 and the rear-tilting support bars 3 to limit the angle of opening.

We claim:

1. A disassemblable folding chair including:

two pairs of support legs, wherein one pair of the two support legs on is on a first side of the chair and one pair of the two support legs on a second side of the chair:

an upholstered seat back;

each pair of support legs is formed by a front-tilting support bar hinged to a rear-tilting support bar;

a pair of front diagonal bars are connected between the front-tilting support bar of the first pair of support legs and the front-tilting support bar of the second pair of support legs by a moveable hinge;

a pair of rear diagonal bar pair are connected between the rear-tilting support bar of the first pair of support legs and the rear-tilting support bar of the second pair of support legs by a moveable hinge, the two rear-tilting support bars are taller than the two front-tilting support bars, and a portion of the taller support bars extends upward to provide a support for the seat back;

wherein one end of the pair of front diagonal bars is directly hinged to the two front-tilting support bars, and an other end of the pair of front diagonal bars is hinged on the front-tilting support bars by a detachable structure;

one end of the pair of rear diagonal bars is directly hinged onto the two rear-tilting support bars; and an other end of the pair of rear diagonal bars is mounted on the rear-tilting support bars via a detachable structure.

2. The disassemblable folding chair of claim 1, wherein a position of the detachable structure located on one end of the pair of front diagonal bars and the pair of rear diagonal bars is secured by a bolt, and includes a plastic component affixed to the detachable positions that correspond to the front-tilting support bars and the rear-tilting support bars, where the plastic component has a bolt hole so that the bolt can be screwed thereto.

3. The disassemblable folding chair of claim 1, wherein the movable hinge that joins the front-tilting support bar and the rear-tilting support bar adopts one of the following two structures: 1) the front-tilting support bar and the rear-tilting support bar are crossed and hinged together by a rivet; or 2) the rear-tilting support bar is mounted with a sliding cap on the top; the front-tilting support bar passes through that sliding cap to create the movable hinge.

4. The disassemblable folding chair of claim 1, wherein the rear-tilting support bar has a sectional structure which includes a support section and a seat back section;

The seat back section is inserted at the end of the support section to be integrally connected to each other; and The upholstered seat back cushion is attached to the upper portion of the seat back area and the upper portion of the front-tilting support bars.

5. The disassemblable folding chair of claim 4, wherein the upper portion of the seat back area is mounted with an immovable plastic component for seat back, and the upper portion of the front-tilting support bars is mounted with an immovable plastic component for the seat; and the upholstered seat back cushions are directly affixed to the plastic components for the seat and the seat back.

6. The disassemblable folding chair of claim 5, wherein the plastic component for the seat is mounted securely on a short bar so that it is immovable, and the insertion of a short bar in the upper portion of the front-tilting support bars creates a fixed positioning structure.

7. The disassemblable folding chair of claim 4, wherein a diameter of the seat back section and a diameter of the support section of the rear-tilting support bars are identical to each other; and a core tube is inserted in the lower part of the seat back section, wherein the core tube is also inserted into the upper part of the support section so that the two sections are joined together as one unit.

* * * * *